United States Patent [19]

Stewart

[11] Patent Number: 5,033,156

[45] Date of Patent: Jul. 23, 1991

[54] FLOW REGULATOR AND SCRAPER FOR A CONCRETE MIXER DISPENSING CHUTE

[75] Inventor: John B. Stewart, Cookstown, Canada

[73] Assignee: Canadian Automotive Safety Products Ltd., New Lowell, Ontario, Canada

[21] Appl. No.: 476,848

[22] Filed: Feb. 8, 1990

[51] Int. Cl.[5] ..... B25B 33/00; A47L 25/00

[52] U.S. Cl. ..... 15/236.05; 15/105; 15/236.04; 15/236.07

[58] Field of Search ..... 15/236.01, 236.04, 236.05, 15/236.07, 236.09, 104.16, 242, 105; 172/371, 372, 373, 375, 378, 380; 81/485, 488; 30/169, 171; 222/191, 319, 342

[56] References Cited

U.S. PATENT DOCUMENTS

| | | | |
|---|---|---|---|
| 1,649,921 | 11/1927 | Paluck | 172/371 |
| 2,291,015 | 7/1942 | Anderson | 30/171 |
| 2,437,316 | 3/1948 | Gambino et al. | 15/236.01 |
| 2,810,144 | 10/1957 | McIntosh | 30/171 |

FOREIGN PATENT DOCUMENTS

| | | | |
|---|---|---|---|
| 331025 | 12/1920 | Fed. Rep. of Germany | 15/236.01 |
| 334604 | 3/1921 | Fed. Rep. of Germany | 15/236.01 |
| 320130 | 10/1929 | United Kingdom | 15/236.05 |

*Primary Examiner*—Edward L. Roberts
*Attorney, Agent, or Firm*—Rogers & Scott

[57] ABSTRACT

The invention provides a tool for assisting the flow of ready mixed concrete down a sloping chute and also for stopping such flow. The tool includes a retaining plate shaped to fit inside the chute when placed in the chute across the direction of flow. A shaft is connected at one end to the plate and at the other end to an end piece connected generally at right angles to the shaft. The tool may be used by gripping the end piece and placing the end plate in the chute to pull concrete down the dispensing chute. Also, by placing the end piece around a fixture on the chute and the end plate in the chute, flow of concrete down the chute will be limited.

1 Claim, 2 Drawing Sheets

58
40
38
30
22
32
66
58

58
64
40
32
38
22
60
30
62
58

20
29
28
26

41
42
30
22
32
36
34
40
38
24

FIG. 2
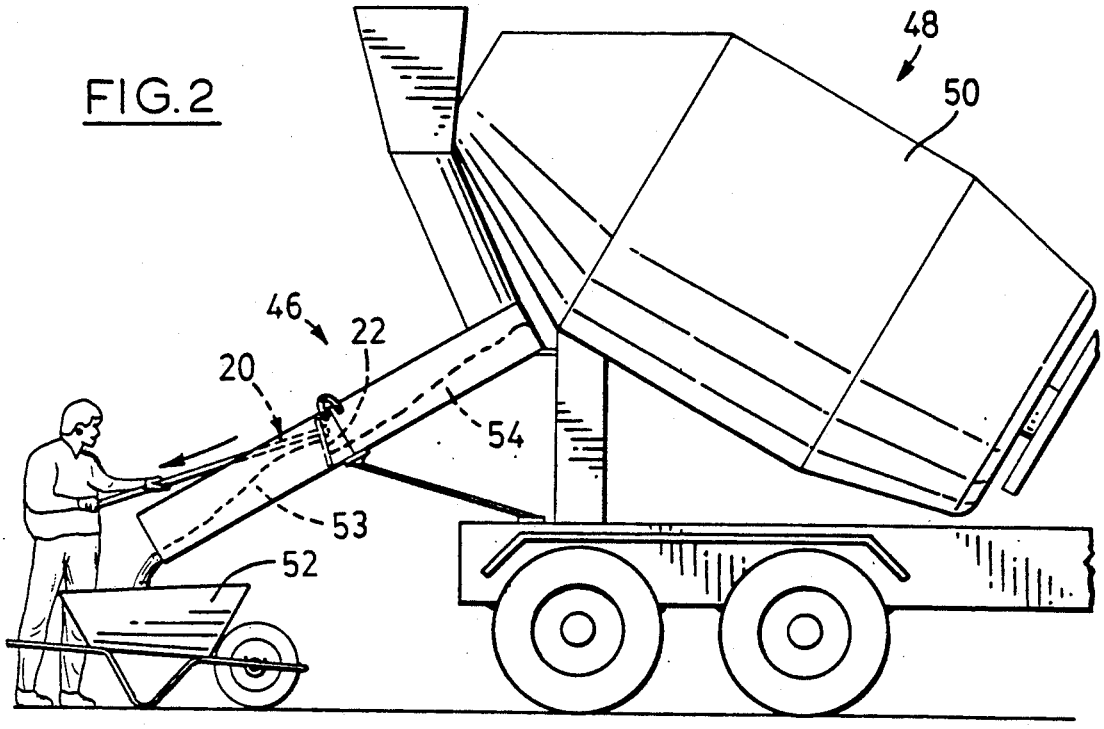
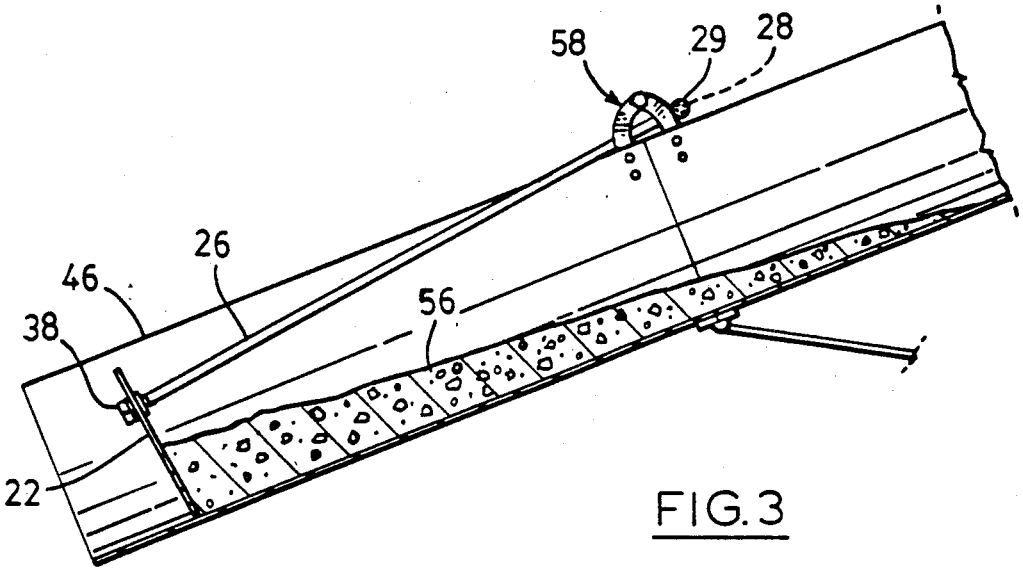
FIG. 3

FLOW REGULATOR AND SCRAPER FOR A CONCRETE MIXER DISPENSING CHUTE

BACKGROUND OF THE INVENTION

This invention relates to a tool for regulating the flow of ready mixed concrete down the discharge chute of a concrete mixer, and more particularly for use with a chute of the type found on trucks supplying ready mixed concrete. The invention will be described with reference to such a truck in exemplary fashion.

Concrete is generally delivered to construction sites in trucks having large mixing drums which are rotated to mix the concrete as the truck travels . This type of drum rotates about an inclined longitudinal axis with reference to the truck and has an elevated rear open end. The inside of the drum is equipped with blade structures arranged in a circumferential helix from one end to the other such that during transit, when the drum is rotated in a first direction, the concrete is mixed, and when the drum is rotated in the opposite direction the concrete is forced towards the open end of the drum where it falls from the drum into a discharge chute. This chute is adjustable so that it can be positioned to guide the concrete to a location where it is needed, for instance into a place where forms have been arranged, or alternatively into a bucket or barrow.

The chute allows concrete to slide slowly towards the lower end of the chute, and of course the chute will contain concrete when the drum stops rotating. Because the consistency of concrete varies according to the work being done, the inclination of the chute is chosen to permit controlled flow over a range of concrete mixtures. In some instances it is necessary to assist the flow and this is done usually by an operator pulling the concrete down the chute using any convenient implement such as a shovel or rake. This tends to be time consuming and not a very convenient way of cleaning the chute.

Another problem with this is that when smaller quantities of concrete are required, such as when filling a wheelbarrow, the flow of concrete must be discontinued when a full barrow is to be removed and replaced by an empty barrow. Commonly this results in lost concrete, and this is particularly a problem when an empty barrow is not availabe.

For the above reasons it is clearly desirable to be able to control the flow of concrete down a chute both by assisting the flow when the chute is to be cleaned out, and also by holding back the flow when it is necessary to discontinue flow from the chute either for a short time, or to hold the contents of the chute when the drum is stopped until it is possible to continue the process of pouring the concrete from the drum.

Accordingly, it is the object of the present invention to provide a robust inexpensive tool for moving concrete down a concrete mixer dispensing chute and also for cleaning the chute. It is a further object to provide such a tool which can also be used to retain concrete in a discharge chute when there is no demand for concrete from the chute.

SUMMARY OF THE INVENTION

The invention provides a tool for assisting the flow of ready mixed concrete down a sloping chute and also for stopping such flow. The tool includes a retaining plate shaped to fit inside the chute when placed in the chute across the direction of flow. A shaft is connected at one end to the plate and at the other end to an end piece connected generally at right angles to the shaft. The tool may be used by gripping the end piece and placing the end plate in the chute to pull concrete down the dispensing chute. Also, by placing the end piece around a fixture on the chute and the end plate in the chute, flow of concrete down the chute will be limited.

BRIEF DESCRIPTION OF THE DRAWINGS

The invention will be better understood with reference to the accompanying drawings in combination with the following description:

FIG. 2 is a schematic view of an operator using the tool to draw concrete down a discharge chute on an exemplary ready mixed concrete truck;

FIG. 3 is a sectional view of the chute and drawn to a larger scale than FIG. 2 to show the use of the tool in restricting flow of concrete down the chute;

Figures 1, 4, 5:
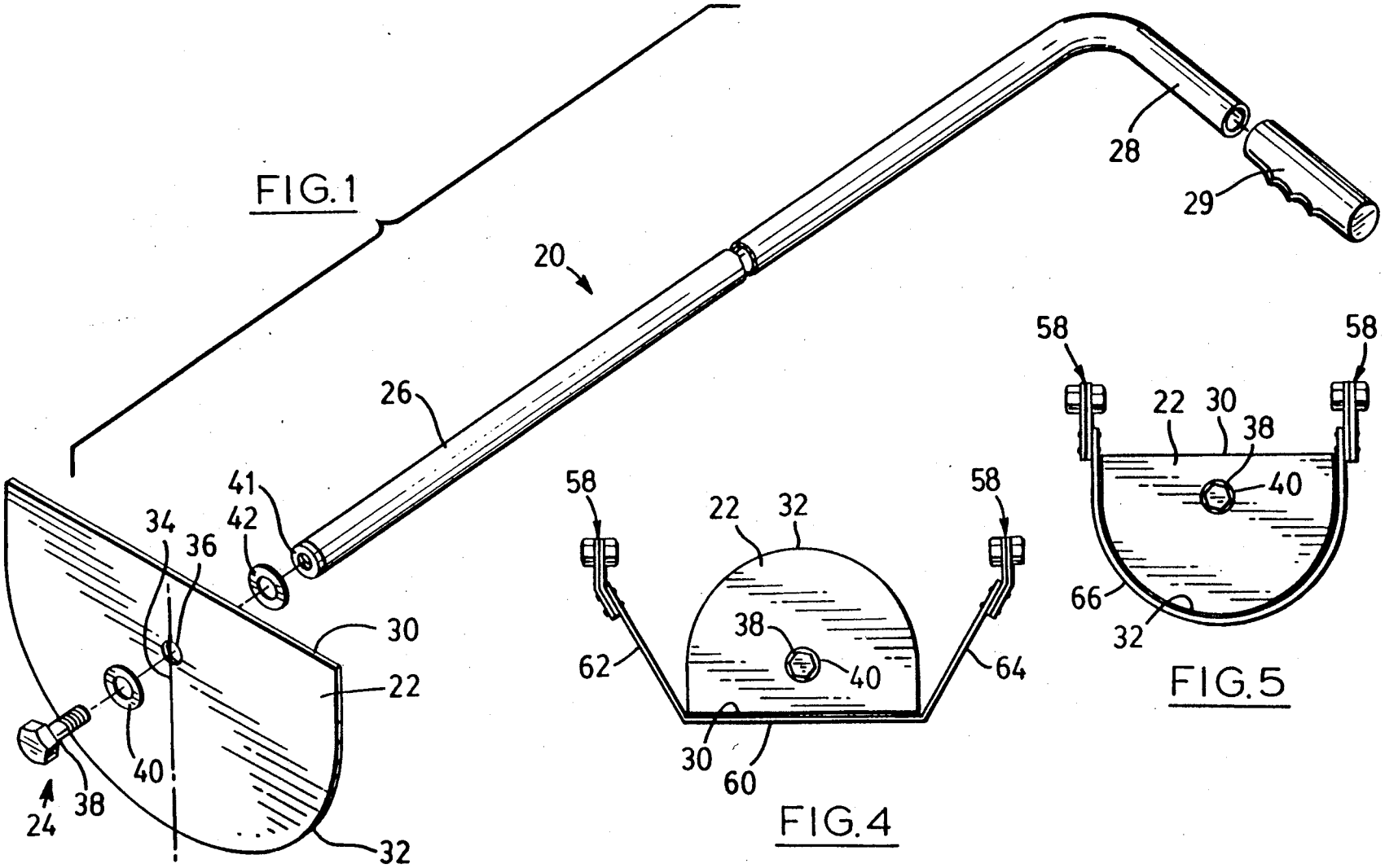
FIG. 1 is an exploded perspective view of a tool according to a preferred embodiment of the invention.
FIG. 4 (drawn adjacent FIG. 1) is an end view showing the tool in use in a chute having straight sides.
FIG. 5 is a view similar to FIG. 4 and showing the tool in use in a chute having a rounded cross-sectional profile.

Reference is made firstly to FIG. 1 which illustrates a tool designated generally by the numeral 20 and consisting of an end plate 22 attached by a fastener 24 to the end of an elongate shaft 26 having an end piece 28 extending generally at right angles to the shaft.

The plate 22 has a straight upper edge 30 and a curved edge 32 extending from the extremeties of the upper edge 30 symmetrically about a center line 34 drawn through an aperture 36 in the plate. This aperture receives a bolt 38 forming part of the fastener 24 which further includes washers 40, 42 to either side of the plate. The fastener is completed by the inclusion of a threaded insert 41 engaged permanently in the end of the tubular shaft 26. The fastener is used to retain the plate in position on the end of the shaft, but of course it would be a simple matter to adjust the angular relationship of the plate with reference to the longitudinal axis of the shaft 26.

At the other end of the shaft from the plate 22 is the end piece 28 which is simply an extension of the shaft bent out of alignment with the shaft and lying generally at right angles both to the shaft and with respect to a plane containing the shaft and the center line 34. A hand grip 29 is provided over the end piece.

As will be described with reference to FIGS. 2 and 3, the plate 22 is always used in contact with concrete whereas the end piece 28 can either be used by the operator as a handle, or used to locate the tool in the chute.

Reference is now made to FIG. 2 which illustrates the use by an operator when pulling concrete from a discharge chute 46 of the type used on the back of a concrete mixing truck designated generally by the numeral 48 and having a mixing drum 50. The flow in the chute is dependent to some extent on continuous flow from the drum 50. New concrete at the top of the chute will tend to push the preceding concrete down the chute and, in this case, into a barrow 52. The operator can use the tool to assist this flow or, should the situation arise where the drum 50 is stopped, then the flow in the chute will tend also to stop and the operator can then use the tool to clean out the chute. It can be seen in FIG. 2 that the tool 20 is being drawn downwardly by the operator and has accumulated concrete 53 ahead of it. Once this concrete is drawn into the barrow, concrete 54 further up the chute will tend to slide more freely and of course can also be drawn down the chute by the operator. This avoids procedures such as banging the chute with obvious possibility of damage and also tends to ensure the concrete is removed and that the chute is kept clean. This is also very important because a clean chute will allow better concrete flow than one which has hardened pieces of concrete in it.

Reference is next made to FIG. 3 which illustrates another use of the tool. In this instance the need is to hold concrete 56 in the chute because the flow has to be restricted for some reason such as finding an empty barrow. The tool is placed in the chute with the shaft 26 extending up the chute from the plate 22 which is at the lower end. The tool is positioned so that the end piece 28 can be hooked around part of the structure of the chute such as hinge structure 58. It is a simple matter to do this in such a way that the tool will remain in position because the shaft 26 is in engagement with the side of the chute and the end piece with the hinge structure 58. This restriction to the flow will contain the concrete and prevent spillage. In fact, if it is necessary to move the truck slightly to re-adjust it, this can be done with the tool in place in the chute.

Remaining with FIG. 3 it will be noted that the proportions of the tool are such that when the tool is hooked onto the structure of the chute, the shaft slopes downwardly into the chute and the plate (which is at right angles to the shaft) consequently slopes such that the plate extends from the shaft somewhat uphill with respect to the chute. As a result, concrete resting on the plate has a component of loading tending to push the plate into the chute. Clearly this is desirable to prevent accidental displacement of the tool and the result can be achieved by varying proportions and angles.

The shape of chute 46 will vary. Two typical chutes are shown in FIGS. 4 and 5. The plate 22 is generally D-shaped in end view due to the use of the straight edge 30 and the curved edge 32. As seen in FIG. 4, the chute has a flat bottom 60 bordered by inclined flat sidewalls 62, 64. The shape of the plate is such that it can be manipulated to clean both the side walls and the bottom wall.

A further arrangement is shown in FIG. 5 in which the chute has a curved wall 66 generally matching the shape of the plate 22 so that this will of course clean very readily.

When stopping the slow of concrete in the manner shown in FIG. 3, the fact that the plate 22 covers a large percentage of the cross-section of the chute shown in FIG. 4, will effectively prevent flow due to the small downward angle of the chute. Clearly the flow will be completely contained in the chute shown in FIG. 5.

Although the shape of the plate has been described as D-shaped with reference to the preferred embodiment, clearly the shape could be modified to match any particular chute. For instance if the tool is to be used only with chutes of the type shown in FIG. 4, then the plate could be shaped accordingly. The preferred embodiment is intended for use in a variety of chutes rather than in a particular type although of course it fits best in the FIG. 5 chute.

The shaft and end piece are made from a single piece of steel tubing of any suitable size and the plate 22 is preferably of nylon which is easy to clean. However, any suitable materials can be used.

Modifications to the shape of the tool within the concept of the invention is anticipated and included in the scope of the claims.

I claim:

1. A tool for use in controlling the flow of ready mixed concrete down a discharge chute, the tool comprising:

a generally D-shaped plate shaped to fit inside and across the chute in the flow of concrete;

a shaft attached at a first end to the plate and having a second end, the shaft extending generally at right angles to the plate;

an end piece attached to the second end of the shaft and extending generally at right angles to the shaft whereby an operator can grip the end piece and place the plate in the chute to draw concrete down the chute or use the end piece to couple the tool to the chute with the plate in the chute thereby holding the concrete in the chute.

* * * * *